US008025182B2

(12) United States Patent
Murayama et al.

(10) Patent No.: US 8,025,182 B2
(45) Date of Patent: Sep. 27, 2011

(54) GAS CARTRIDGE

(75) Inventors: Keijiro Murayama, Tokyo (JP); Katsuhiko Murayama, Tokyo (JP); Jyunichi Tamura, Tokyo (JP); Masakazu Konishi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 464 days.

(21) Appl. No.: 11/657,700

(22) Filed: Jan. 25, 2007

(65) Prior Publication Data

US 2007/0187426 A1 Aug. 16, 2007

(30) Foreign Application Priority Data

Jan. 27, 2006 (JP) ..... P.2006-019119
Feb. 27, 2006 (JP) ..... P.2006-051086
Mar. 30, 2006 (JP) ..... P.2006-095386
May 12, 2006 (JP) ..... P.2006-133662
Nov. 8, 2006 (JP) ..... P.2006-303325

(51) Int. Cl.
*B67D 7/60* (2010.01)

(52) U.S. Cl. ..... 222/95; 222/105; 222/386.5; 222/389

(58) Field of Classification Search ..... 222/95, 222/386.5, 389, 97, 100, 105–107
See application file for complete search history.

(56) References Cited

U.S. PATENT DOCUMENTS 3,389,833 A 6/1968 Ramis
3,721,371 A * 3/1973 Dolveck ..... 222/386.5
3,979,025 A 9/1976 Friedrich et al.
4,013,195 A 3/1977 Ferris
4,095,724 A * 6/1978 Perusco ..... 222/95
4,175,678 A * 11/1979 Fukuda ..... 222/54
4,403,722 A 9/1983 Nikolich
4,415,099 A 11/1983 Paris
4,890,757 A * 1/1990 Robbins, III ..... 220/675
4,969,577 A * 11/1990 Werding ..... 222/94
4,980,757 A * 12/1990 Nishigaki ..... 358/533
5,069,590 A 12/1991 Stoffel
5,115,944 A 5/1992 Nikolich
5,265,765 A * 11/1993 Maier ..... 222/105
5,337,923 A * 8/1994 Lugez et al. ..... 222/183
5,730,328 A * 3/1998 Maeder et al. ..... 222/95
5,865,350 A * 2/1999 Losenno et al. ..... 222/402

(Continued)

FOREIGN PATENT DOCUMENTS

DE 1900704 8/1970

(Continued)

*Primary Examiner* — Kevin P Shaver
*Assistant Examiner* — Andrew Bainbridge
(74) *Attorney, Agent, or Firm* — Morgan, Lewis & Bockius LLP

(57) ABSTRACT

Fuel gas or some other kind of fluid is stored in a collapsible metallic bag that is attached to a valve and is stored inside a rigid outer container. Between the rigid outer container and the collapsible bag is a space or volume filled with compression gas during use which puts a collapsing pressure evenly upon the bag. In order to reduce bag failures, the outer surface of the collapsible bag has a series of projected streak portions that project outwardly from the vertical length of the collapsing in several locations that prevent the bag from expanding to fill the entire space between the rigid outer container and the bag. These projected streaks form recessed portions in the bag's surface which facilitates the bag collapsing in those predetermined locations evenly which in turn reduces the collapsible bag's failure rate from breaking during operation.

2 Claims, 12 Drawing Sheets

U.S. PATENT DOCUMENTS

| | | | | |
|---|---|---|---|---|
| 5,915,595 | A * | 6/1999 | Dow et al. | 222/95 |
| 2002/0070232 | A1 * | 6/2002 | Zwaert et al. | 222/95 |
| 2004/0000562 | A1 | 1/2004 | Gantner | |
| 2004/0084477 | A1 * | 5/2004 | Albaum | 222/95 |
| 2005/0065471 | A1 * | 3/2005 | Kuntz | 604/133 |

FOREIGN PATENT DOCUMENTS

| | | |
|---|---|---|
| DE | 1917247 | 10/1970 |
| DE | 202 00 906 U1 | 11/2002 |
| FR | 1 303 048 | 9/1962 |
| FR | 1428355 | 5/1966 |
| FR | 2259754 | 8/1975 |
| FR | 2316132 | 1/1977 |
| FR | 2 820 127 | 8/2002 |
| FR | 2820127 | 8/2002 |
| GB | 1072404 | 6/1967 |
| GB | 1 341 355 | 12/1973 |
| JP | A-49-03213 | 1/1974 |
| JP | A-55-048068 | 4/1980 |
| JP | B-55-026073 | 7/1980 |
| JP | 57-178676 | 2/1982 |
| JP | U-59-131267 | 9/1984 |
| JP | U-60-018927 | 2/1985 |
| JP | U-60-148281 | 10/1985 |
| JP | U-60-169163 | 11/1985 |
| JP | A-61-246051 | 11/1986 |
| JP | 5-77844 | 3/1993 |
| JP | 06-005618 | 1/1994 |
| JP | B2-2873691 | 1/1999 |
| JP | 2004-044804 | 2/2004 |
| JP | 2004-263285 | 9/2004 |
| JP | A-2005-263285 | 9/2005 |
| TW | 183169 | 5/1992 |
| TW | 359476 | 5/1999 |
| TW | 415280 | 12/2000 |
| TW | 458895 | 10/2001 |
| TW | 491728 B | 6/2002 |
| TW | 543513 | 7/2003 |
| TW | 1232916 | 5/2005 |

* cited by examiner

GAS CARTRIDGE

BACKGROUND OF THE INVENTION

1. Technical Field

The present invention relates to a gas cartridge for supplying a fuel gas which is used for a strike tool of a gas nailer or the like for striking a fastener of a nail, a screw or the like by a combustion pressure of the gas.

2. Background Art

A strike tool for striking a fastener of a nail, a screw or the like by a combustion pressure of a gas is charged with a gas cartridge and the gas is supplied from the gas cartridge. In a normal case, a gas cartridge is provided with a multiple structure comprising an outer vessel (outer can), a gas charge vessel (inner bag), and an inner space formed between the two vessels. A liquefied fuel gas at inside of the gas charge vessel is injected by compressing to deform the gas charge vessel by utilizing a pressure of a compression gas at high pressure charged into the inner space.

Further, the outer vessel and the gas charge vessel of the gas cartridge having the above-described two chamber structure pressure charging apparatus are made of aluminum, particularly, the gas charge vessel is easy to be deformed by receiving a press force of the compression gas, the gas at inside is not permeated to outside, and therefore, a comparatively thin vessel which is easily deformable is preferred (JP-B2-2873691).

Meanwhile, according to the vessels of the multiple structure of the gas cartridge, the fuel gas at inside of the gas charge vessel is discharged to outside of the gas cartridge by pressing to crush to thereby recess to deform the gas charge vessel by the pressure of the compression gas charged to the inner space between the two vessels. Deformation of the gas charge vessel utilizing the pressure of the gas is free deformation, and therefore, there is a case in which the gas charge vessel is not uniformly deformed. That is, at an initial stage of deforming the gas charge vessel, a portion having a weak rigidity is recessed to deform, deformation of the portion is further promoted, and therefore, in a number of cases, only one portion is considerably recessed to deform.

Further, since an opening portion and a bottom portion of the gas charge vessel are highly rigid and difficult to be deformed, and therefore, a stress is concentrated on a portion excluding these portions, further, deformation is continuously progressed from an initially deformed portion which is deformed initially, and therefore, only one portion is considerably deformed. Therefore, a wrinkle or a fold is brought about at the portion, and a crack or a pin hole is produced. For example, as shown by FIG. 15, a bottom portion 12 of an inner bag 2 is pulled to an opening side, a stress is liable to be concentrated on a boundary portion 13 between the bottom portion 12 and a side face portion 10, and therefore, there is brought about a phenomenon that the bottom portion 12 is considerably deformed to fall down to the opening side. When a crack or a pin hole is produced at the gas charge vessel in accordance therewith, the compression gas is brought into the inner bag charged with a gas, and therefore, the pressure of the compression gas is relatively reduced and a gas charge vessel is not sufficiently compressed. Therefore, the fuel gas is discharged insufficiently, and a function thereof as a gas can is lost while the fuel gas remains. Abandoning the fuel gas before being sufficiently utilized not only deteriorates an operational efficiency of the strike tool constituting a drive source by the gas but also constitutes an economic loss.

In this way, according to the gas cartridge, both of the outer can and the inner bag are made of a metal, particularly, the inner bag is thin-walled, and therefore, there poses a particular problem that a crack or a pin hole is liable to be produced.

SUMMARY OF THE INVENTION

One or more embodiments of the invention provide a gas cartridge in which a deformation of recessing an inner bag is made not to be deviated by preventing a stress from being concentrated only on a portion of the inner bag by a compression gas to thereby enable to effectively prevent a crack or a pin hole from being produced at the inner bag by improving the gas cartridge by particularly placing a view point to improving the inner bag.

According to a first aspect of the invention, a gas cartridge arranged with a metal made inner bag charged with a fuel gas at inside of a metal made outer can, and charged with a compression gas for pressing to crush the inner bag in accordance with consumption of the gas at a space between the outer can and the inner bag, includes a deformation introducing portion integrally formed at the inner bag for introducing a deformation produced at the inner bag when a press force of the compression gas is received in accordance with consumption of the fuel gas.

Further, according to a second aspect of the invention, in the gas cartridge according to the first aspect, the deformation introducing portion may be a plurality of recessed streak portions formed along a longitudinal direction of the inner bag.

Further, according to a third aspect of the invention, in the gas cartridge according to the first aspect, the deformation introducing portion may be a plurality of thick-walled portions formed in a strip-like shape along a longitudinal direction of the inner bag.

Further, according to a fourth aspect of the invention, in the gas cartridge according to the first aspect, the deformation introducing portion may be a projected streak portion formed in a rib-like shape along a longitudinal direction of the inner bag.

Further, according to a fifth aspect of the invention, in the gas cartridge according to the first aspect, the deformation introducing portion may be a three-dimensional pattern having recesses and projections in a diamond cut shape.

Further, according to a sixth aspect of the invention, in the gas cartridge according to the first aspect, the deformation introducing portion may be a three-dimensional pattern having recesses and projections in a bellows-like shape.

According to the first aspect, the inner bag is integrally formed with the deformation introducing portion for producing an initial deformation, and therefore, the inner bag is pressed to crush to deform by the press force of the compression gas in accordance with the consumption of the gas at inside of the inner bag. At this occasion, the initial deformation which is deformed initially urges a successive deformation, and therefore, the deformation is progressed successively from the initially deformed portion. In this way, the deformation can be introduced intentionally, and the deformation by the compression gas can be dispersed to a plurality of portions so as not to be deviated to a portion on which a stress is concentrated. Further, the initial deformation is determined by the deformation introducing portion, and therefore, a possibility of initially deforming a portion which is physically inferior in a rigidity the most is low. Therefore, a crack or a pin hole by a wrinkle or a fold can effectively be prevented from being produced.

Further, according to the second aspect, the deformation introducing portion is the plurality of recessed streak portions formed along the longitudinal direction of the inner bag, and therefore, the deformation produced at the inner bag is successively progressed from the recessed streak portions when the press force of the compression gas is received in accordance with consumption of the fuel gas. In this way, the deformation can intentionally be introduced, and therefore, a crack or a pin hole by a wrinkle or a fold can effectively be prevented from being produced.

Further, according to the third aspect, the deformation introducing portion is the projected streak portion formed in the rib-like shape along the longitudinal direction of the inner bag, and therefore, the projected streak portion is difficult to be deformed, and the deformation can intentionally be introduced at a portion which is not provided with the deformation introducing portion. Therefore, a crack or a pin hole by a wrinkle or a fold can effectively be prevented from being produced.

Further, according to the fourth aspect, the deformation introducing portion is the plurality of strip-like thick-walled portions, and therefore, the deformation introducing portion is difficult to be deformed, and the deformation can intentionally be introduced at a portion which is not provided with the deformation introducing portion. Therefore, a crack or a pin hole by a wrinkle or a fold can effectively be prevented from being produced.

Further, according to the fifth aspect, the deformation introducing portion is the three-dimensional pattern having recesses and projections in the diamond cut shape, and therefore, the deformation of the inner bag by the pressure gas is not concentrated on one portion but is progressed in various direction. Therefore, a crack or a pin hole can effectively be prevented from being produced.

Further, according to the sixth aspect, the deformation introducing portion is the three-dimensional pattern having recesses and projections in the bellows-like shape, and therefore, in deforming the inner bag by the pressure gas, the inner bag is regularly deformed to contract by being pressed to crush in the longitudinal direction. Therefore, a crack or a pin hole can effectively be prevented from being produced.

Other aspects and advantages of the invention will be apparent from the following description and the appended claims.

DESCRIPTION OF REFERENCE NUMERALS AND SIGNS

G1 . . . liquefied fuel gas
G2 . . . compression gas
1 . . . outer can
2 . . . inner bag
3 . . . cap valve member
P1 through P7 . . . deformation introducing portions

DETAILED DESCRIPTION OF THE EXEMPLARY EMBODIMENTS

An explanation will be given of an exemplary embodiment and a number of modes of the invention in reference to the drawings as follows.

Although a gas charged to an inner bag is normally a liquefied gas, the gas is not necessarily limited to be the liquefied gas.

Figure 1:
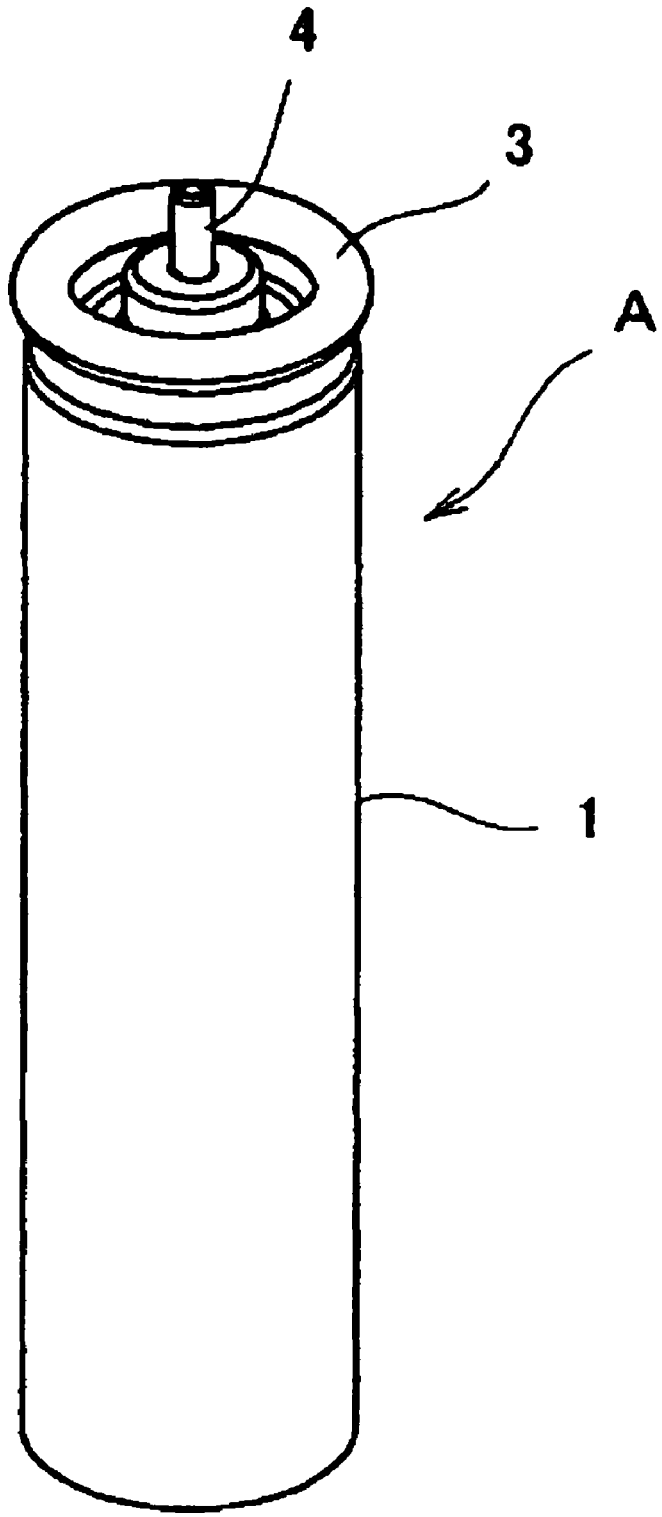
FIG. 1 is a perspective view of a gas cartridge according to an exemplary embodiment of the invention.
Figure 2A:
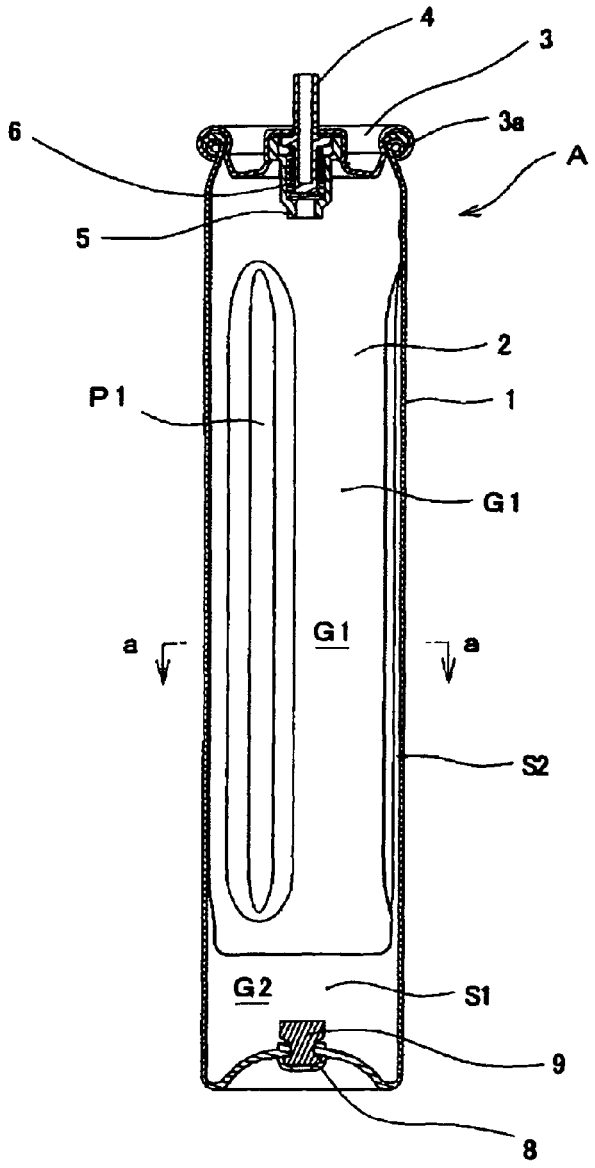
FIG. 2A is a vertical sectional view of the gas cartridge.
Figure 2B:
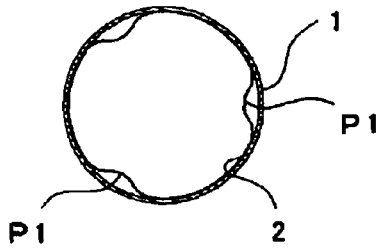
FIG. 2B is a sectional view taken along a line a-a of FIG. 2A.
Figure 3:
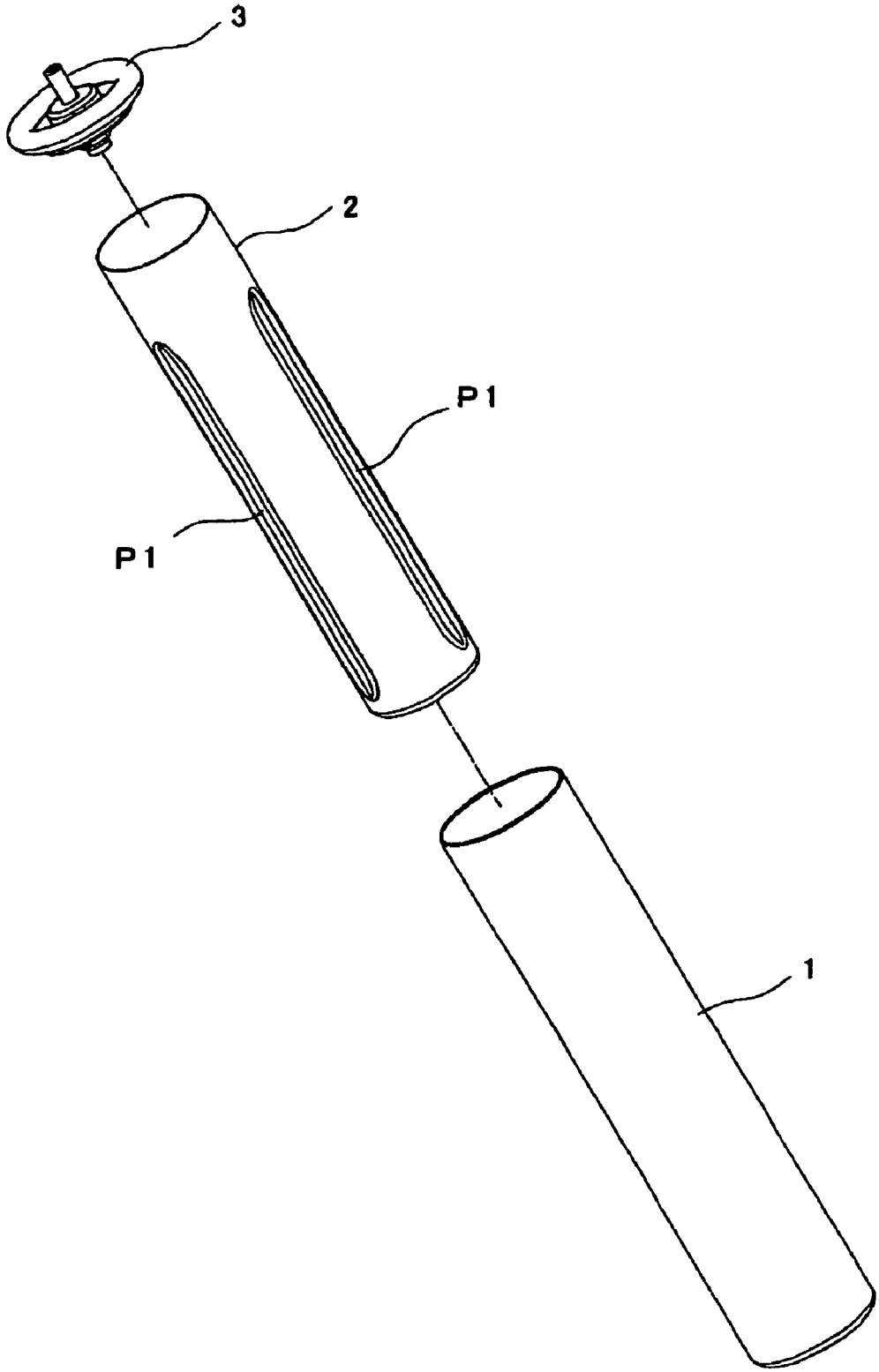
FIG. 3 is a disassembled perspective view of the gas cartridge.

In FIG. 1 through FIG. 3, notation A designates a gas cartridge. The gas cartridge A is constituted by an outer can 1, an inner bag 2 arranged at inside of the outer can 1, a cap valve member 3 for injecting a gas charged into the inner bag 2 and the like.

As shown by FIG. 3, the outer can 1 comprises a cylindrical member made of aluminum having a predetermined diameter and a predetermined length and a predetermined wall thickness, one end thereof is opened and other end thereof is closed. In contrast thereto, the inner bag 2 is arranged at inside of the outer can 1, and therefore, in a state in which a gas to be charged to inside thereof is not charged yet, the inner bag 2 comprises a thin aluminum made bottomed cylindrical member which is provided with an outer shape similar to that of the outer can 1, smaller than the outer can 1, and easy to be deformed.

Figure 4A:
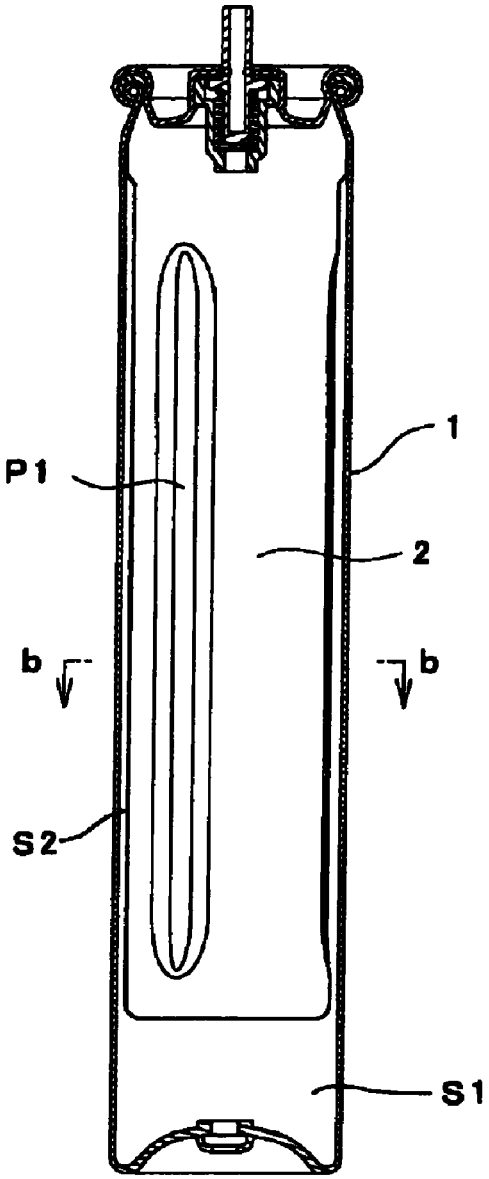
FIG. 4A is a vertical sectional view of the gas cartridge before charging a gas.
Figure 4B:
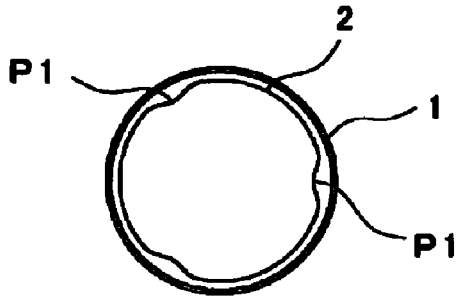
FIG. 4B is a sectional view taken along a line b-b of FIG. 4A.

The inner bag 2 is inserted into the outer can 1. Further, opening edges of the outer can 1 and the inner bag 2 are integrally bonded to each other by being seamed to a peripheral edge 3*a* of the cap valve member 3. Further, in a state in which the gas is not charged yet, as shown by FIG. 4A and FIG. 4B, a side portion space S2 is formed between an outer peripheral face of the inner bag 2 and an inner peripheral face of the outer can 1. At the same time, a bottom portion space S1 is continuously formed between a bottom portion of the outer can 1 and a bottom portion of the inner bag 2.

Inside of the inner bag 2 is charged with a liquefied fuel gas G1 from an injection pipe 4 of the cap valve member 3. At this occasion, the inner bag 2 is bulged as shown by FIG. 2A and FIG. 2B. Further, the inner spaces S1, S2 of the outer can 1 of the vessel are charged with a compression gas G2 for pressing to crush the inner bag 2 for injecting the gas. The compression gas G2 is at a pressure higher than a pressure of the liquefied fuel gas G1 for injecting the liquefied fuel gas G1 from the injection pipe 4 of the cap valve member 3 to outside by pressing a surface of the inner bag 2 and pressing to crush the inner bag 2 and normally, a gas of propane, propylene, butane or the like is used therefor. The bottom portion of the outer can 1 is formed with a cap 8 for charging the compression gas, the compression gas G2 is charged therefrom, and the cap 8 is sealed by a plug 9.

Thereby, as shown by FIG. 1, FIG. 2A and FIG. 2B, there is formed the gas cartridge A having a double structure of a concentrical arrangement mainly constituted by the outer can 1 and the inner bag 2 and including the cap valve member 3.

In the above-described constitution, when the gas cartridge is used for a strike tool or the like, by pressing the injection pipe 4 against a force of a spring 6 for urging a valve member 5, the valve member 5 is opened, thereby, the gas at inside of the inner bag 2 is injected to outside. Further, in accordance with discharging the gas at inside of the inner bag 2, the inner bag 2 is going to be pressed to crush by the compression gas G2 at inside of the outer can 1, since the pressure at inside of the inner bag 2 is not reduced, the liquefied fuel gas G1 is continuously injected.

Next, the inner bag 2 is directly and uniformly formed with 3 pieces (not limited to 3 pieces) of recessed streak portions P1 as deformation introducing portions. The recessed streak portion P1 may previously be formed at a stage of fabricating the inner bag 2. Further, the recessed streak portion P1 may be constituted by an intermittent shape other than the shape prolonged in a longitudinal direction.

According to the constitution, when pressed to crush by the compression gas G2, a deformation is introduced and progressed precedingly from 3 pieces of the recessed streak portions P1 formed uniformly at the inner bag 2, and therefore, the deformation by pressing is uniformly dispersed to 3 portions. The deformation can be introduced intentionally in this way, and therefore, crack or a pin hole can effectively prevented from being produced.

Figure 5A:
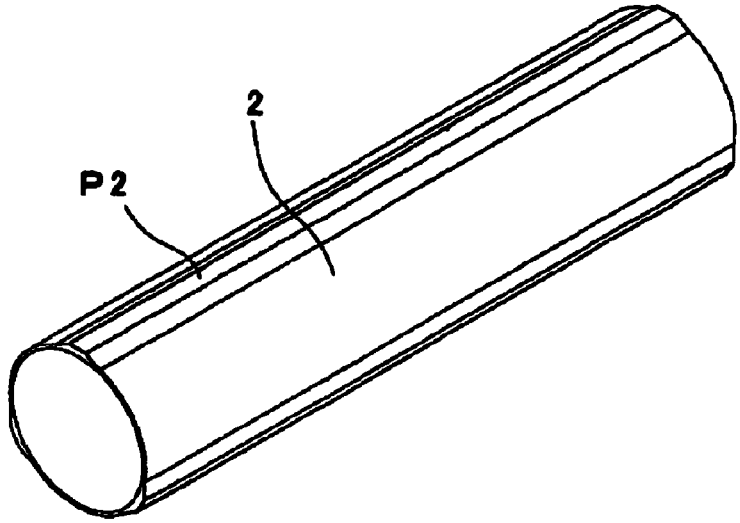
FIG. 5A relates to a modified example of the exemplary embodiment of the invention and is a perspective view of a state of constituting a deformation introducing portion by providing a thick-walled rib at an outer face of an inner bag.
Figure 5B:
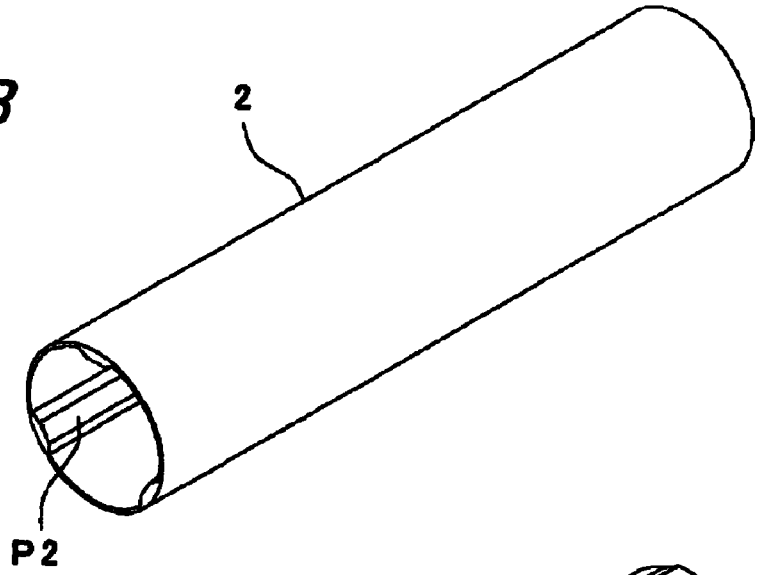
FIG. 5B relates to a modified example of the exemplary embodiment of the invention and is a perspective view of a state of constituting a deformation introducing portion by providing a thick-walled rib at an inner face of the inner bag.
Figure 5C:
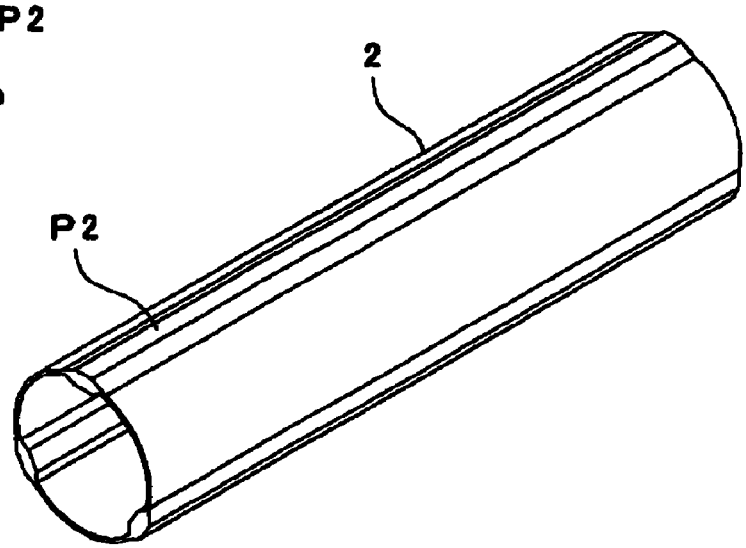
FIG. 5C relates to a modified example of the exemplary embodiment of the invention and is a perspective view of a state of constituting a deformation introducing portion by providing thick-walled ribs at an inner face and an outer face of an inner bag.

Next, in FIG. 5A, as a deformation introducing portion, a thick-walled portion P2 in a strip-like shape is formed along a longitudinal direction of an outer peripheral face of the inner bag 2. The thick-walled portion P2 may be projected to an inner side face of the inner bag 2 as shown by FIG. 5B and may be constructed by a constitution of being projected to two inner and outer side faces of the inner bag 2 as shown by FIG. 5C other than being formed to project to the outer side face of the inner bag 2.

According to the constitution, since the thick-walled portion P2 of the inner bag 2 is thick-walled, when the inner bag 2 is pressed to crush by the compression gas G2, the thick-walled portion P2 is difficult to be deformed, and therefore, other portion of the inner bag 2 is precedingly recessed to deform. In this way, the deformation can intentionally be introduced to a number of portions which are not provided with the deformation introducing portion and therefore, a local stress concentration is avoided, and the deformation by the compression gas G2 is not deviated to one portion. Therefore, a crack or a pin hole by a wrinkle or a fold can effectively be prevented from being produced.

Figure 6A:
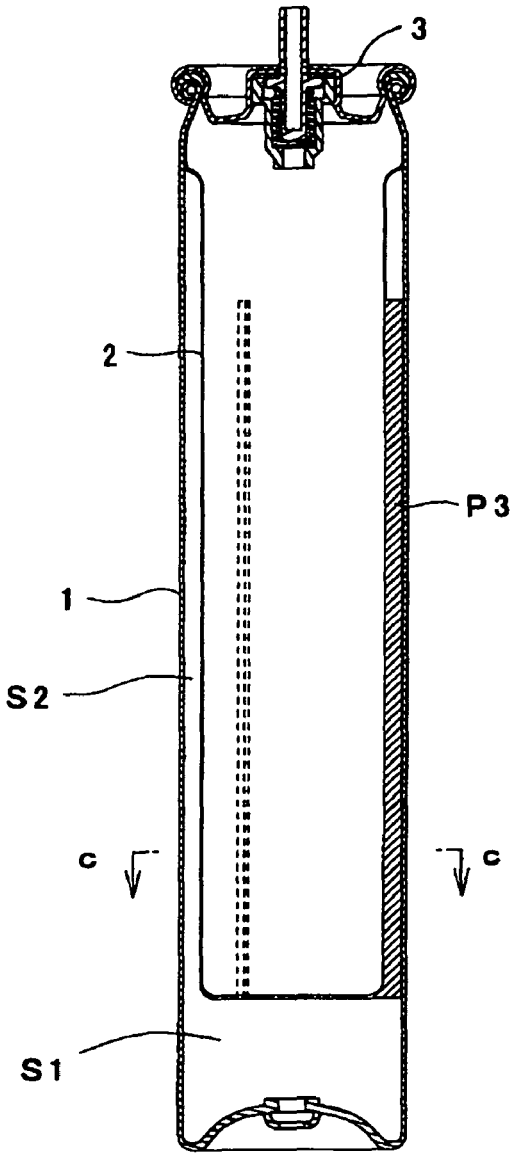
FIG. 6A is a vertical sectional view of other mode of a cartridge according to the exemplary embodiment of the invention.
Figure 6B:
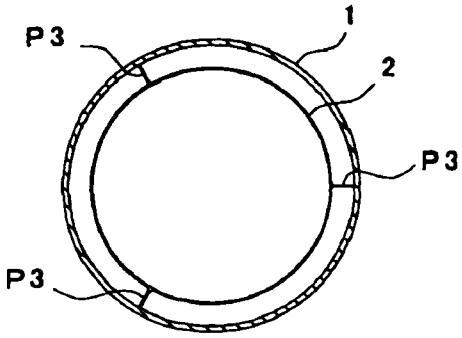
FIG. 6B is a sectional view taken along a line c-c of FIG. 6A.
Figure 7:
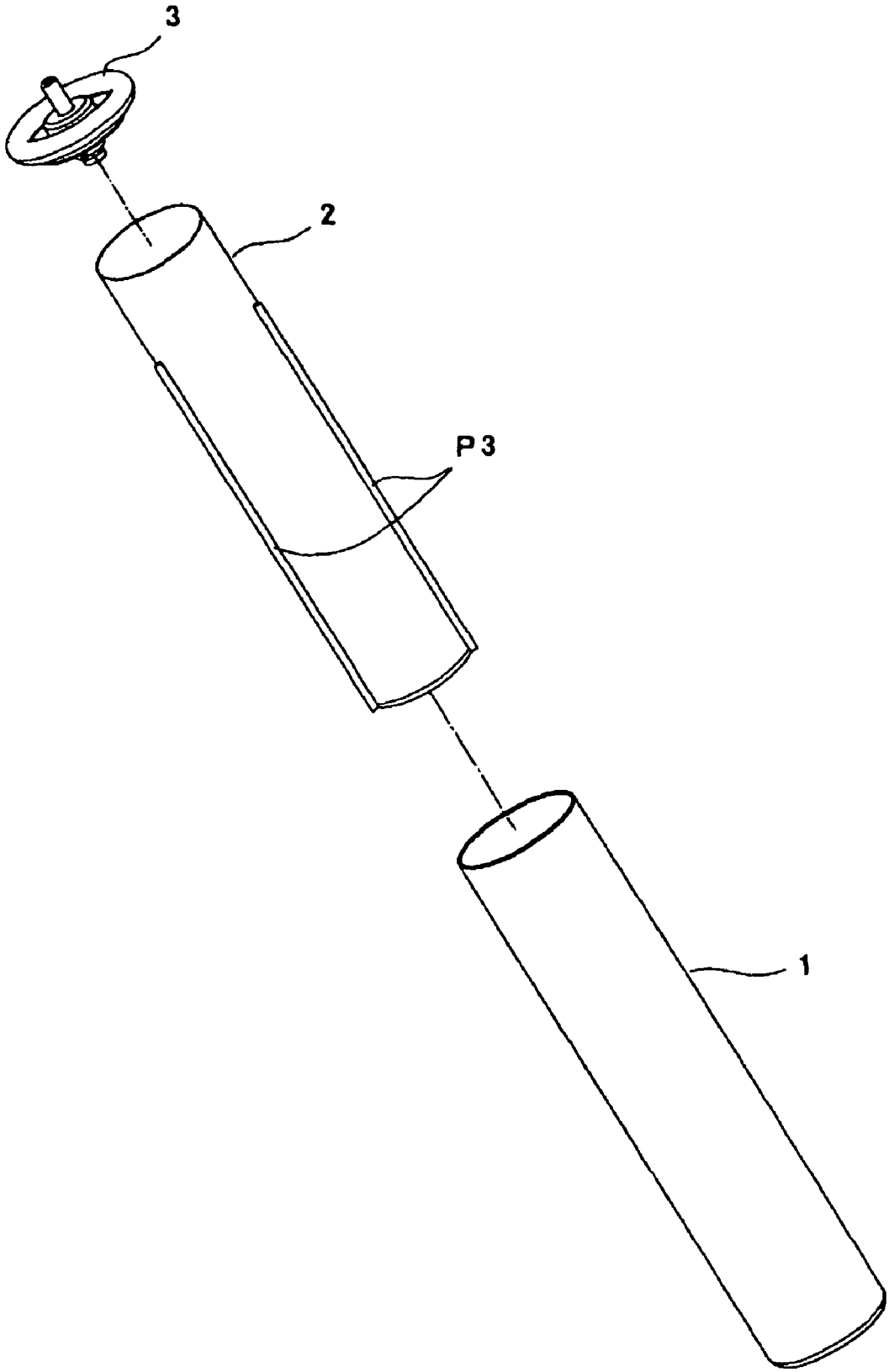
FIG. 7 is a disassembled perspective view of the gas cartridge.

Meanwhile, FIG. 6A through FIG. 7 show an embodiment when deformation introducing portions are constituted by a plurality of rib-like projected streak portions P3 projected to form at the outer peripheral face of the inner bag 2.

Figure 8A:
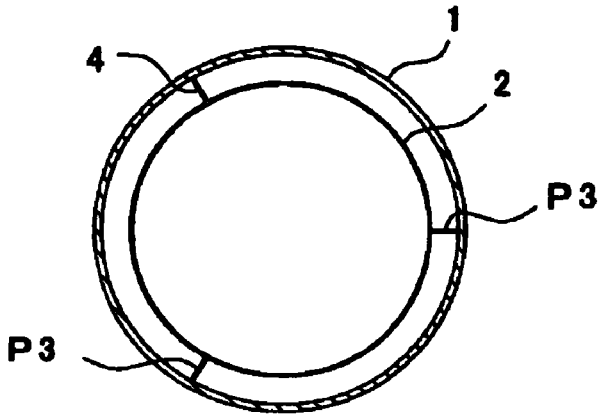
FIG. 8A is a cross-sectional view showing a state of deforming an inner bag by a deformation introducing portion in a rib-like shape, showing a state in which a liquefied fuel gas is not charged yet.
Figure 8B:
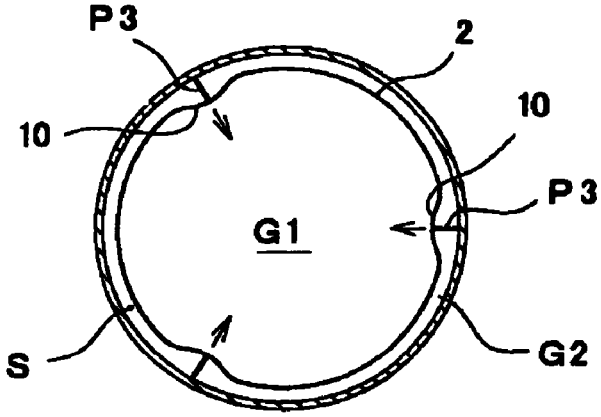
FIG. 8B is a cross-sectional view showing a state of deforming the inner bag by the deformation introducing portion in the rib-like shape, showing a state of charging the liquefied fuel gas.

An explanation will be given of a behavior of deforming the inner bag by charging the gas in reference to FIG. 8A through FIG. 8C. First, from a state in which the gas is not charged yet as shown by FIG. 8A, when inside of the inner bag 2 is charged with the liquefied fuel gas G1 which is liquefied as shown by FIG. 8B, although the inner bag 2 is deformed to bulge by the pressure in charging, the projected streak portion P3 of the inner bag 2 is butted to the inner face of the outer can 1, and the inner bag 2 cannot be bulged by constituting a hindrance by the projected streak portion P3, and therefore, a recessed portion 10 is formed at the inner bag 2. Further, the compression gas G2 at high pressure is going to be charged to the spaces S1, S2 between the outer can 1 and the inner bag 2.

Figure 8C:
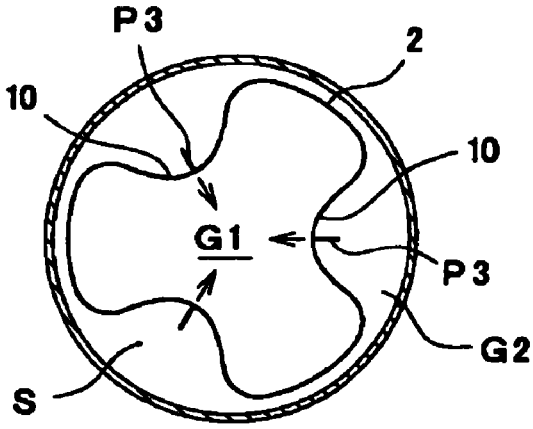
FIG. 8C is a cross-sectional view showing a state of deforming the inner bag by the deformation introducing portion in the rib-like shape, showing a state after deformation.

In the above-described constitution, when the gas cartridge is used for a strike tool or the like, although the inner bag 2 is pressed to crush to deform by the compression gas G2 in accordance with consumption of the liquefied fuel gas G1 at inside of the inner bag 2, as shown by FIG. 8B and FIG. 8C, the deformation is naturally urged to progress precedingly from the deformed recessed portion 10 formed by the projected streak portion P3. Further, the deformation can be introduced intentionally to a portion which is not provided with the deformation introducing portion. Therefore, the deformation by pressing is not deviated to one portion but is uniformly dispersed to 3 portions, and therefore, a local stress concentration is avoided, and a crack or a pin hole by a wrinkle or a fold can effectively be prevented from being produced.

Further, the recessed portion 10 formed at the inner bag 2 is not previously formed but is an initial deformation formed by the projected streak portion P3 after the liquefied fuel gas G1 is charged, a wrinkle is difficult to be produced in the deformation in charging the gas. Therefore, also a pin hole is difficult to be produced.

Further, a separate frame-like member or a special working step is not needed for uniformly deforming the inner bag 2, and therefore, also cost can be restrained to be low.

Further, the projected streak portion P3 is not limited to the outer peripheral face of the inner bag. The projected streak portion P3 may be formed at the inner peripheral face. Because in this case, in accordance with discharging the gas at inside of the inner bag, when the inner bag is pressed to crush by the compression gas G2 at inside of the outer can, a portion provided with the projected streak portion P3 is difficult to be deformed, and therefore, a portion between the ribs is precedingly deformed, the deformation by pressing is not deviated to one portion but is uniformly dispersed to 3 portions.

Figure 9:
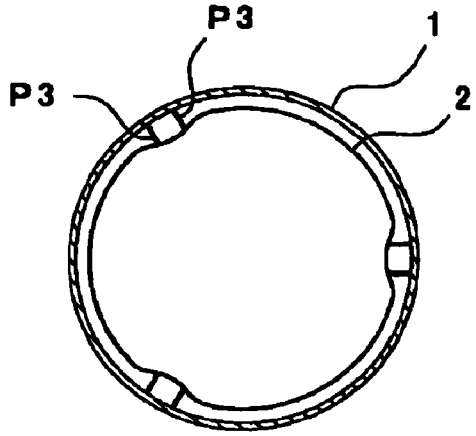
FIG. 9 is a cross-sectional view of other example of a rib-like deformation introducing portion.

The projected streak portions P3 may doubly be formed at the respective portions as shown by FIG. 9.

Figure 10:
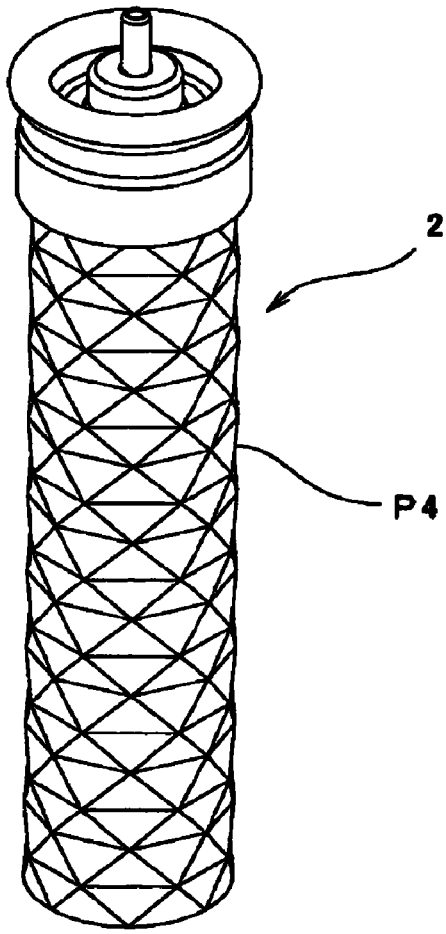
FIG. 10 is a perspective view of other mode of a deformation introducing portion of an inner bag.

Further, as a mode of a case of directly forming the deformation introducing portion at the inner bag 2, a three-dimensional pattern P4 having recesses and projections in a diamond cut shape shown in FIG. 10 may directly be formed at the outer peripheral portion of the inner bag 2. The three-dimensional pattern P4 may be constructed by a constitution of being formed evenly and uniformly substantially over an entire face of the outer peripheral portion of the inner bag 2 excluding a vicinity of the opening portion.

According to the above-described constitution, the deformation of the inner bag by the pressure gas becomes regular urged along the recesses and projections of the three-dimensional pattern P4, is not concentrated on one portion and progressed in various directions. Therefore, a crack or a pin hole can effectively be prevented from being brought about.

Figure 11:
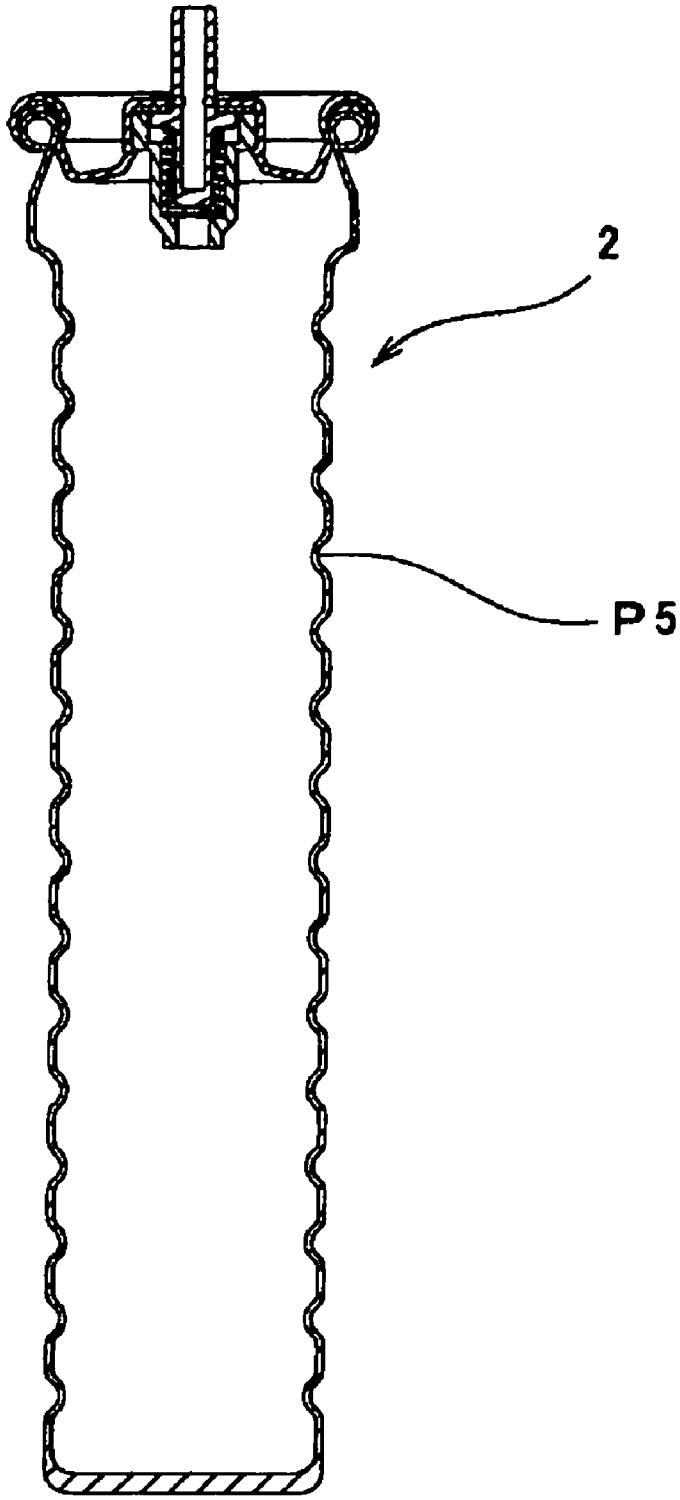
FIG. 11 is a vertical sectional view of still other mode of the deformation introducing portion.

Further, a three-dimensional pattern P5 having a recesses and projections in a bellows-like shape may directly be formed at the outer peripheral portion of the inner bag 2 as shown by FIG. 11. The three-dimensional pattern P5 may uniformly be formed substantially over an entire face of the outer peripheral portion of the inner bag 2 excluding portions at a vicinity of the opening portion and at a vicinity of the bottom portion.

Although the inner bag 2 formed with the recesses and projections in the diamond cut shape, or the three-dimensional pattern by the recesses and projection in the bellows-like shape P4, P5 in this way is pressed to crush to deform by the compression gas G2 in accordance with the consumption of the liquefied fuel gas G1 at inside thereof, in the deformation, the inner bag 2 is contracted to deform regularly by being pressed to crush in the longitudinal direction in accordance with the recesses and projections of the three-dimensional pattern P5. Therefore, the uniform deformation of being contracted in the longitudinal direction is progressed as a whole. Therefore, a crack or a pin hole is effectively prevented from being produced.

Further, according to the embodiments, it is not necessary to provide a special deformation introducing portion between the outer can and the inner bag, and therefore, there is not a concern of enlarging an outer diameter or deteriorating the outlook.

Figure 12:
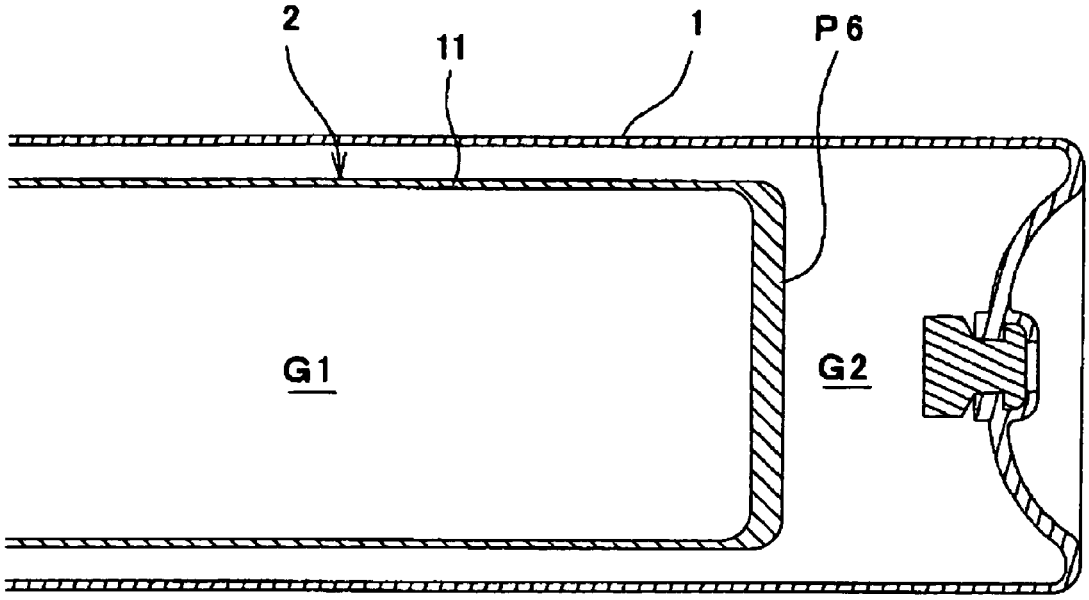
FIG. 12 is a vertical sectional view of a state of constituting a deformation introducing portion by providing a thick-walled rib at a bottom portion of an inner bag.

Further, as a deformation introducing portion formed at the inner bag 2 per se, as shown by FIG. 12, there may be constructed a constitution of forming a thick-walled portion P6 at the bottom portion of the inner bag 2. Also in this case, the thick-walled portion P6 is difficult to be deformed, the deformation can intentionally be introduced to a number of portions which are not provided with the deformation introducing portion, and therefore, when the inner bag 2 is pressed to crush by the compression gas G2, a stress is made to be difficult to concentrate locally, and therefore, a portion of the inner bag 2 can effectively be prevented from being deformed considerably.

It is preferable to constitute a thickness of the thick-walled portion P6 of the bottom portion of the inner bag 2 to be at least twice as much as or larger than a thickness of the side face portion 11.

Figure 13:
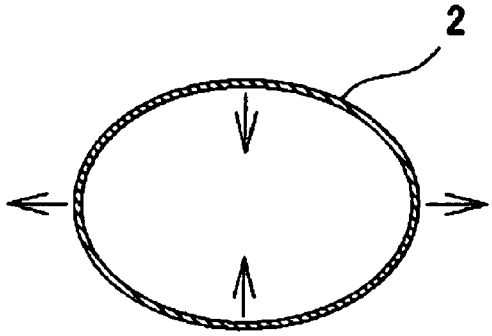
FIG. 13 is a cross-sectional view constituting a deformation introducing portion by constituting a sectional shape of an inner bag by an elliptical shape.

Further, as a deformation introducing portion formed at the inner bag 2 per se, as shown by FIG. 13, a shape of a cross-sectional face of the inner bag 2 may be constituted not to be a circular shape but an elliptical shape.

In this case, when the inner bag 2 is applied with a press force by the compression gas G2, the inner bag 2 is pressed to crush as shown by arrow marks, a stress is not concentrated on a portion, and therefore, only a portion of the inner bag 2 can effectively be prevented from being deformed significantly.

Figure 14A:
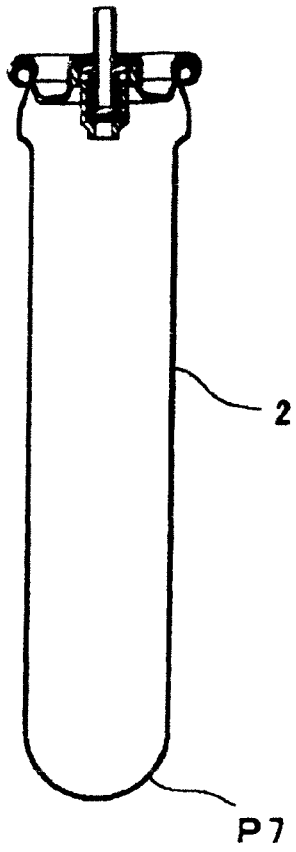
FIG. 14A is a cross-sectional view constituting a deformation introducing portion by constituting a shape of a bottom portion of an inner bag by a spherical shape.

Further, as a deformation introducing portion formed at the inner bag 2 per se, as shown by FIG. 14A, a shape of a bottom portion P7 of the inner bag 2 may be formed not by a shape of a circular plate but by a semispherical shape.

In this case, when the press force by the compression gas G2 is applied, in comparison with a constitution of bending the bottom portion and the side face portion substantially orthogonal to each other as in the background art, a portion on which a stress is concentrated is difficult be produced, and therefore, a total thereof is crushed. Therefore, only a portion of the inner bag 2 can effectively be prevented from being deformed considerably.

Figure 14B:
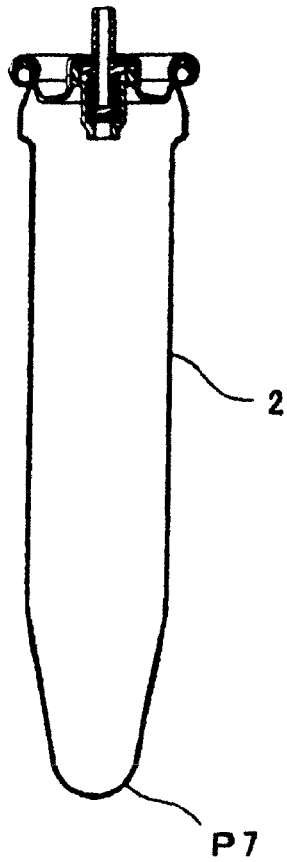
FIG. 14B is a cross-sectional view constituting a deformation introducing portion by constituting a shape of a bottom portion of an inner bag by a spherical shape.
Figure 15:
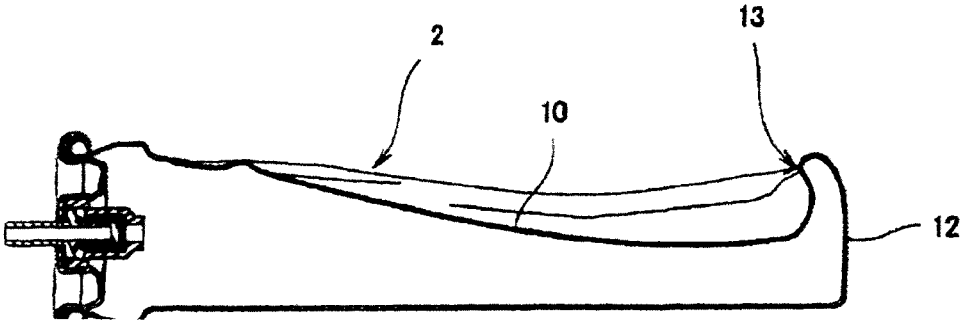
FIG. 15 PRIOR ART
FIG. 15 is a vertical sectional view showing an example of deformation of an inner bag of a background art.

Further, the shape of the bottom portion is not limited to the semispherical shape. As shown by FIG. 14B, a front end of the bottom portion P7 may be sharpened more or less.

Although an explanation has been given of the invention in details and in reference to the specific embodiments, it is apparent for the skilled person that the invention can variously be changed or modified without deviating from the spirit and the range of the invention.

The application is based on Japanese Patent Application (Japanese Patent Application No. 2006-019119) filed on Jan. 27, 2006, Japanese Patent Application (Japanese Patent Application No. 2006-051086) filed on Feb. 27, 2006, Japanese Patent Application (Japanese Patent Application No. 2006-095386) filed on Mar. 30, 2006, Japanese Patent Application (Japanese Patent Application No. 2006-133662) filed on May 12, 2006, and Japanese Patent Application (Japanese Patent Application No. 2006-303325) filed on Nov. 8, 2006, and a content thereof is incorporated herein by reference.

INDUSTRIAL APPLICABILITY

The invention can preferably be utilized for a gas cartridge for supplying a fuel gas used in a strike tool of a gas nailer or the like for striking a fastener of a nail, a screw or the like by a combustion pressure of a gas.

What is claimed is:

1. A gas cartridge comprising:

an outer can;

an inner bag with an axial center positioned inside of the outer can; and a projected streak portion projecting from a portion of an outer peripheral face of the inner bag in a radial direction and extending in a longitudinal direction of the inner bag, wherein a leading end of the projected streak portion in the radial direction is in contact with an inner peripheral face of the outer can, and wherein, in a cross section perpendicular to the longitudinal direction, a radial distance between the axial center of the inner bag and the portion from which the projected streak portion projects is shorter than the radial distance between the axial center of the inner bag and another portion of the outer peripheral face of the inner bag.

2. The gas cartridge according to claim 1, wherein the outer can is a metallic outer can, and the inner bag is a metallic inner bag, and wherein inside of the metallic inner bag is charged with a fuel gas, and a space between the outer can and the inner bag is charged with a compression gas for pressing to crush the inner bag in accordance with consumption of the gas.

* * * * *